US010835906B2

(12) United States Patent
Schinkel

(10) Patent No.: US 10,835,906 B2
(45) Date of Patent: Nov. 17, 2020

(54) FOAMING UNIT FOR PRODUCING FOAM FROM A MIXTURE OF GAS AND LIQUID AND A SPRAYER FOR PRODUCING AND DISPENSING FOAM

(71) Applicant: S O L O Kleinmotoren Gesellschaft mit beschraenkter Haftung, Sindelfingen (DE)

(72) Inventor: Samuel Schinkel, Weil der Stadt (DE)

(73) Assignee: S O L O Kleinmotoren Gesellschaft mit beschraenkter Haftung, Sindelfingen (DE)

( * ) Notice: Subject to any disclaimer, the term of this patent is extended or adjusted under 35 U.S.C. 154(b) by 83 days.

(21) Appl. No.: 16/093,592

(22) PCT Filed: Apr. 5, 2017

(86) PCT No.: PCT/EP2017/058090
§ 371 (c)(1),
(2) Date: Oct. 12, 2018

(87) PCT Pub. No.: WO2017/190908
PCT Pub. Date: Nov. 9, 2017

(65) Prior Publication Data

US 2019/0118199 A1 Apr. 25, 2019

(30) Foreign Application Priority Data

May 6, 2016 (DE) ..... 10 2016 108 447

(51) Int. Cl.
*B05B 7/00* (2006.01)
*B05B 11/00* (2006.01)
(Continued)

(52) U.S. Cl.
CPC ..... *B05B 7/0037* (2013.01); *A47K 5/14* (2013.01); *A62C 5/022* (2013.01); *B05B 7/0062* (2013.01); *B05B 11/3087* (2013.01)

(58) Field of Classification Search
CPC . B05B 7/0062; B05B 7/0037; B05B 11/3084; B05B 11/3087; A47K 5/14;
(Continued)

(56) References Cited

U.S. PATENT DOCUMENTS 2,229,441 A * 1/1941 Carlson ..... B01F 3/04808 261/75
2,391,110 A * 12/1945 Walker ..... B01F 5/0682 366/131
(Continued)

FOREIGN PATENT DOCUMENTS

DE 20 2011 050 649 U1 12/2011
EP 2 308 603 A1 4/2011
(Continued)

*Primary Examiner* — Joseph A Greenlund
(74) *Attorney, Agent, or Firm* — Aslan Law, P.C.

(57) ABSTRACT

A foaming unit for producing foam from a mixture of gas and liquid. The foaming unit comprising a housing, a slide, a foaming element, an inlet for the mixture of gas and liquid and an outlet, the slide and the housing being movable relative to each other, the foaming element being arranged hydraulically between the inlet and the outlet, wherein an active volume of the foaming element can be adjusted by changing the relative position of a control edge and an end face of the foaming element.

10 Claims, 12 Drawing Sheets

(51) Int. Cl.
*A62C 5/02* (2006.01)
*A47K 5/14* (2006.01)

(58) Field of Classification Search
CPC ... A47K 5/1211; A62C 5/02; A62C 5/022024; A62C 31/12; A62C 5/022; A62C 5/024; F16K 31/524
USPC ..... 222/190; 239/343; 251/215, 251
See application file for complete search history.

(56) References Cited

U.S. PATENT DOCUMENTS 2,577,024 A * 12/1951 Lundberg ..... B05B 15/30 239/343
2,577,025 A * 12/1951 Lundberg ..... B05B 7/0037 239/590.3
3,388,868 A * 6/1968 Watson ..... D06B 19/0094 239/427
3,622,049 A * 11/1971 Thompson ..... B05B 7/0037 222/190
4,018,364 A * 4/1977 Wright ..... A45D 27/02 222/190
4,219,159 A * 8/1980 Wesner ..... B05B 7/0062 239/343
4,874,248 A * 10/1989 Luetzelschwab ..... B01F 5/0683 366/307
4,932,567 A * 6/1990 Tanabe ..... B05B 7/0062 222/190
5,048,750 A * 9/1991 Tobler ..... B05B 7/0037 222/190
5,356,565 A * 10/1994 Southwell ..... B01F 5/0406 166/309
5,520,337 A * 5/1996 Fuchs ..... B05B 7/0031 239/427
5,611,490 A * 3/1997 Barriac ..... B05B 7/0062 239/333
5,848,752 A * 12/1998 Kolacz ..... A62C 31/12 239/428.5
6,557,783 B1 * 5/2003 Foster ..... B05B 1/3468 239/333
7,735,692 B2 * 6/2010 Nelson ..... B05B 11/3087 222/190
8,678,241 B2 * 3/2014 Wang ..... B05B 11/3023 222/190
8,740,450 B2 * 6/2014 Mogami ..... B01F 5/0604 366/340
8,794,600 B2 * 8/2014 Chou ..... B01F 5/0496 261/28
8,820,585 B1 * 9/2014 Banks ..... B05B 7/0037 222/190
2002/0130198 A1 * 9/2002 Bennett ..... B05B 7/0037 239/343
2004/0084481 A1 * 5/2004 Foster ..... G01F 11/028 222/190
2005/0284887 A1 * 12/2005 Lewis ..... B05B 7/0037 222/181.3
2006/0219738 A1 * 10/2006 Ilzuka ..... B05B 7/0037 222/190
2008/0093386 A1 * 4/2008 Arminak ..... B05B 11/3094 222/190
2009/0020552 A1 * 1/2009 van der Heijden ..... B05B 11/3087 222/190
2009/0039110 A1 * 2/2009 Brouwer ..... B05B 7/0037 222/190
2009/0039111 A1 * 2/2009 Tu ..... B01F 3/04446 222/190
2009/0266846 A1 * 10/2009 Iizuka ..... B05B 7/0037 222/190
2010/0320232 A1 * 12/2010 van der Heijden ..... B05B 11/3087 222/190
2011/0193245 A1 * 8/2011 Chang ..... B01F 5/0496 261/96
2011/0297700 A1 * 12/2011 Santagiuliana ..... B05B 11/3001 222/153.13
2012/0241477 A1 * 9/2012 Uehira ..... B05B 7/0037 222/190
2013/0068794 A1 * 3/2013 Kodama ..... B05B 11/047 222/190
2014/0034679 A1 * 2/2014 Fitzpatrick ..... A47K 5/14 222/190
2014/0209639 A1 * 7/2014 Sasaki ..... B65D 51/1644 222/190
2015/0223647 A1 * 8/2015 Brouwer ..... B05B 11/0008 222/190
2015/0246250 A1 * 9/2015 Marino ..... A62C 31/03 239/11
2015/0352580 A1 * 12/2015 Kakuta ..... B05B 7/0031 222/190
2016/0167075 A1 * 6/2016 Mizushima ..... B05B 11/3097 222/189.11
2016/0367084 A1 * 12/2016 Mizushima ..... B05B 11/0064
2017/0067339 A1 * 3/2017 Horlein ..... B05B 7/0037
2017/0265691 A1 * 9/2017 Ophardt ..... F04B 15/00
2017/0266680 A1 * 9/2017 Ophardt ..... F04B 53/102
2017/0368564 A1 * 12/2017 Baker ..... B01F 17/0085
2018/0326434 A1 * 11/2018 Aoyama ..... B05B 11/306
2019/0118199 A1 * 4/2019 Schinkel ..... B05B 7/0037

FOREIGN PATENT DOCUMENTS

EP 2 869 931 A1 2/2017
WO WO 2008/049854 A1 5/2008
WO WO 2014/008274 A1 1/2014
WO WO 2015/128235 A2 9/2015

* cited by examiner

A - A

FOAMING UNIT FOR PRODUCING FOAM FROM A MIXTURE OF GAS AND LIQUID AND A SPRAYER FOR PRODUCING AND DISPENSING FOAM

There is a need in many fields to create a foam and apply it to an object, surface or wall. Typical applications include cleaning said surfaces or applying foams that act as release agents, and the like.

Foams of this kind are produced by pressure sprayers. In WO 2014/008274 A1 a pressure sprayer is described in which the consistency of the foam is not adjustable. In said pressure sprayer, a foaming element is secured in a slide. The slide is used to open or close an inlet and thus turn the pressure sprayer on or off.

Another pressure sprayer is described in detail in EP 2 308 603 A1. In a pressure vessel of the pressure sprayer, a liquid and a gas, usually air, are pressurized. The liquid later forms the desired foam and the gas acts as a propellant for producing the foam. The liquid and the propellant (air) are supplied to a foaming element by means of a suction hose. The foaming element is a body made of a porous material. When the liquid is forced through said porous material with sufficient pressure together with the propellant, the desired foam is produced upon exiting the foaming element.

Said foam is then guided through a nozzle which can be designed as a round nozzle or a flat nozzle. The nozzle does not significantly contribute to foam formation, but is used primarily to dispense the foam.

Depending on the application, the foam produced by the pressure sprayer has to be more or less solid or dry, or more or less moist or liquid.

In order to be able to adjust the consistency of the foam, it is known from EP 2 308 603 A1 to arrange various felt disks one behind the other and to adjust the desired consistency of the foam by selecting the felt disks and the number of felt disks. This means that the number of felt disks and consequently, their total volume is altered in order to adjust the desired consistency of the foam.

This type of adjustment of the consistency of the foam works. However, to adjust the foam, the spray head of the sprayer has to be disassembled, additional felt pads installed, or one or more of the existing felt pads removed or replaced with other felt disks. This type of adjustment of the consistency of the foam is time-consuming and impractical. Therefore, for convenience or to save time, the user will often not, or only inadequately, adjust the consistency of the foam. As a result, work results are not optimal and/or more of the foam-forming liquid is consumed than required.

The problem addressed by the invention is therefore that of providing a foaming unit which allows the consistency of the foam produced to be quickly and easily adjusted.

This problem is solved in a foaming unit for producing foam from a mixture of gas and liquid in accordance with the preamble of claim 1, comprising a housing, a slide, a foaming element, an inlet for a mixture of gas and liquid and an outlet, the foaming element being hydraulically arranged between the inlet and the outlet, in that an active volume of the foaming element can be adjusted by changing the relative position of a control edge and an end face of the foaming element.

This means that the foaming element, which is located in the foaming unit, does not have to be replaced nor the dimensions thereof altered in order to alter the consistency of the foam. Instead, by covering the foaming element in regions, the length of the flow path of propellant and liquid through the foaming element can be controlled. Depending on the length of the flow path, a larger or smaller region of the foaming element is activated or deactivated. As a result, the active volume of the foaming element changes and—in the case of otherwise identical constraints—as a result, the consistency of the foam produced also changes. It has been demonstrated in various tests, that in this way the consistency of the foam produced can be adjusted within very wide limits, such that foam with the desired consistency can be produced for almost all applications.

In order to achieve this, the sprayer according to the invention does not need to be dismantled. Therefore, adjusting the consistency of the foam is much faster and can be carried out easily and safely even under harsh conditions of use. This saves working time and always ensures optimum consistency of the foam.

In an advantageous embodiment of the invention, the foaming element is accommodated in a passage opening in the housing and the active volume of the foaming element changes depending on the relative position of a control edge and an end face of the foaming element. As a result, the path that the mixture of pressurized propellant and the liquid to be foamed must take through the foaming element is easily lengthened or shortened. Consequently, the volume (active volume) of the foaming element involved in the foaming of the liquid is increased or decreased.

One option for controlling the active volume is to provide a housing, with the housing and the slide being movable relative to each other. Consequently, the distance between the end face and the control edge also changes in the manner according to the invention when said components are moved relative to each other.

In an advantageous embodiment of the invention, the housing has a recess for the foaming element. One end of the foaming element is accommodated and held in said cap-like recess. It can also be held in this recess by spring force. This means that one end of the foaming element is always deactivated and the liquid and the propellant gas enter the foaming element via a side surface thereof and exit at an end face of the foaming element, at the opposite side to the recess.

In this way, the adjustment or alteration of the active volume of the foaming element is particularly easy to accomplish: the passage opening connected to the slide and the control edge of said opening are pushed over the foaming element to a greater or lesser extent. This controls the size of the active volume of the foaming element.

It is also possible, for example, to form a receiving pin on the slide onto which the foaming element is pushed. If the passage opening and the control edge are part of the housing, the active volume can be controlled by moving the slide and consequently also the foaming element.

It is furthermore possible to form the control edge on the slide and to push the slide into the foaming element to a greater or lesser extent. As a result, the active volume of the foaming element can also be controlled.

The structural design of this principle according to the invention can ultimately be accomplished in various ways. Therefore, only particularly preferred embodiments of the concept according to the invention are described in the embodiments and in the claims. This is not to be associated with a restriction to said embodiments.

Depending on the materials from which the foaming element and the housing are made, it is conceivable for the foaming element to be secured in the recess in the manner of a press connection. It is also possible for a compression spring arranged between the slide and the foaming element to press the foaming element into the recess in the housing.

In many embodiments, it has proven to be advantageous for the slide to be guided in the housing. It is important to ensure that the slide is sealingly guided in the housing such that, firstly, no undesired pressure reduction of the propellant takes place and that the foam does not escape between the housing and the slide in an uncontrolled manner.

It has proven advantageous in many cases for the slide to be secured against rotation relative to the housing.

In order to make adjusting the active volume of the foaming element easy and reliable, a device for adjusting the active volume is provided which, when actuated, alters the relative position of the slide and the housing.

Said device may be a cam mechanism actuated by an adjustment wheel. In a preferred embodiment, the adjustment wheel is rotatably mounted on the housing and has a link which interacts with a pin formed on the slide. In this embodiment, it is now possible, by simply turning the adjustment wheel, to move the slide relative to the housing and thereby to vary the active volume of the foaming element.

Alternatively, it is also possible, by means of a slide designed as a sleeve nut which interacts with a thread on the housing, the slide having a tubular portion that has a passage opening and a control edge, to make the desired change to the relative position of the control edge and end face of the foaming element by turning the sleeve nut.

It is possible according to the invention to integrate the inlet, through which the propellant and the liquid are brought into the foaming unit, into the housing or into the slide. For the quality of the foam produced, both arrangements are of equal value. Which variant is given preference on a case-by-case basis is ultimately a question of the available space and the design effort.

The foaming element may be a commercially available filter element made of an open-pored material. Felt, non-woven fabric, synthetic fabric and/or metal fabric have proven to be particularly suitable. Combinations of these or other materials are also possible. In general, the pressure loss caused by the material ought to be as low as possible.

It is also possible for the foaming element to be designed as a hollow cylinder. It is important in connection with the invention for the active volume of the foaming element to be adjustable. This can be achieved most easily with prismatic bodies (cylindrical rollers, hollow cylinders). The adjustment range of the foaming unit can be extended if a foaming unit consists of regions of different porosity. For example, it is conceivable for a cylindrical foaming element to have a first region having a first porosity and, connected to said first region, a second region made of a different material or of the same material but having a different porosity.

The desired material combinations and porosities have to be adapted to the application and in particular to the liquid to be foamed.

The problem addressed by the invention is also solved by a sprayer comprising a pressure vessel, a foaming unit and a spray nozzle, in that the foaming unit is a foaming unit according to any of the preceding claims.

The sprayer is preferably a pressure sprayer comprising a manual or motor-operated pressure pump.

Further advantages and advantageous embodiments of the invention can be found in the following drawings, the description thereof and the claims. All features disclosed in the description, the figures and the description of said figures may be essential to the invention individually or in any combination with one another.

DRAWINGS

In the drawings:

FIGS. 1*a*) and *b*) schematically show a foaming unit according to the invention;

FIGS. 2*a*) and *b*) also schematically show a foaming unit according to the invention;

Figure 8:
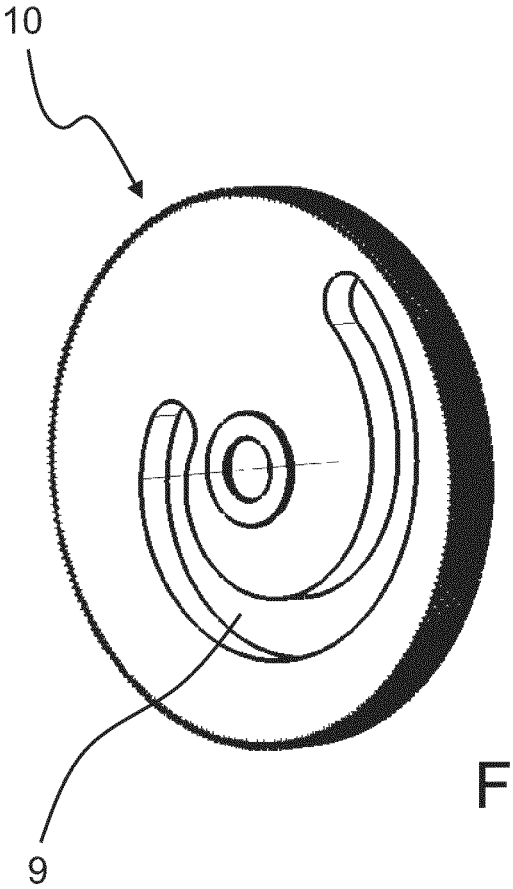
Figure 9:
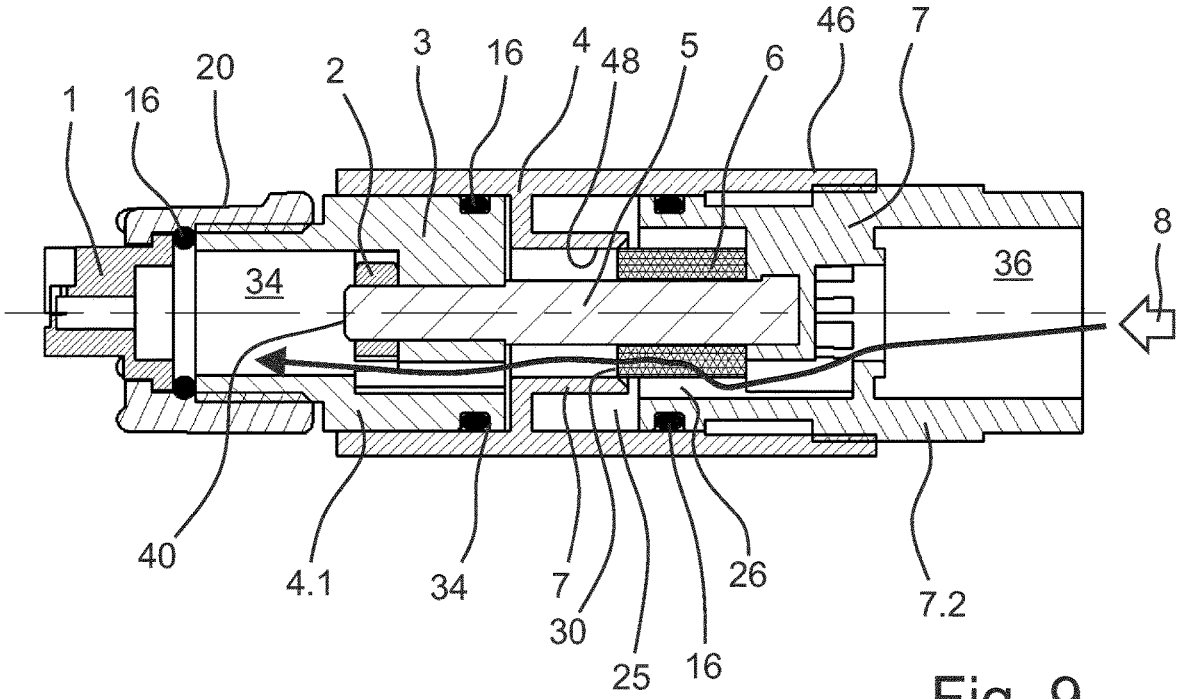
Figure 10:
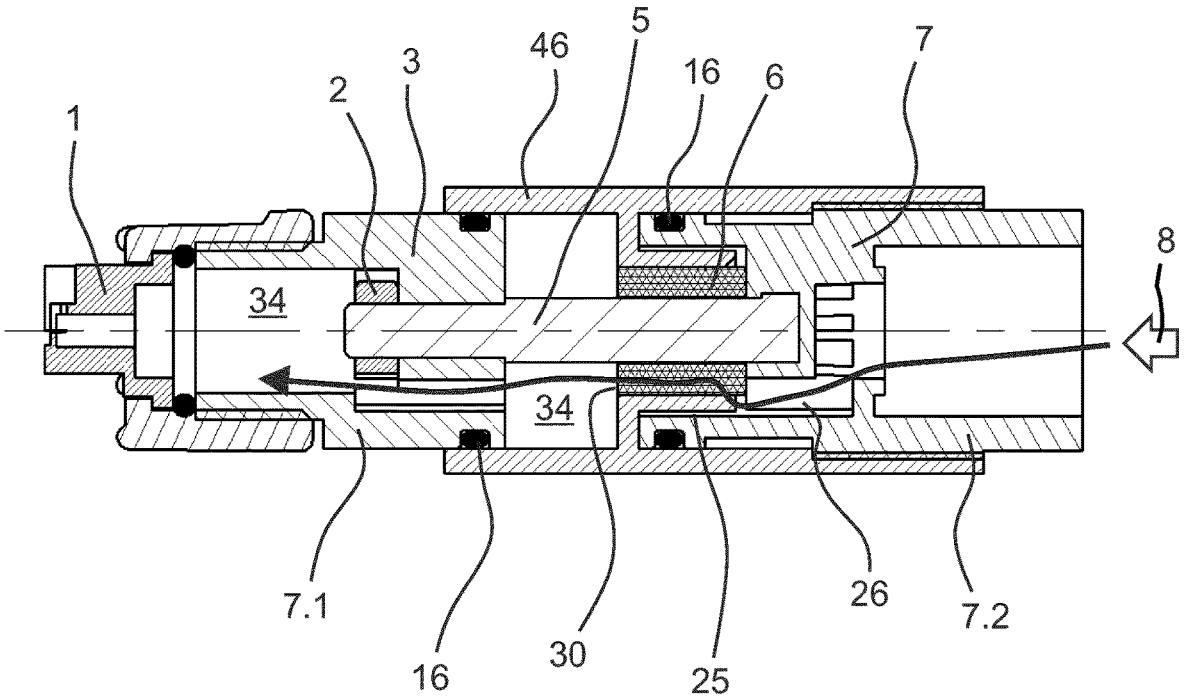
Figure 16:
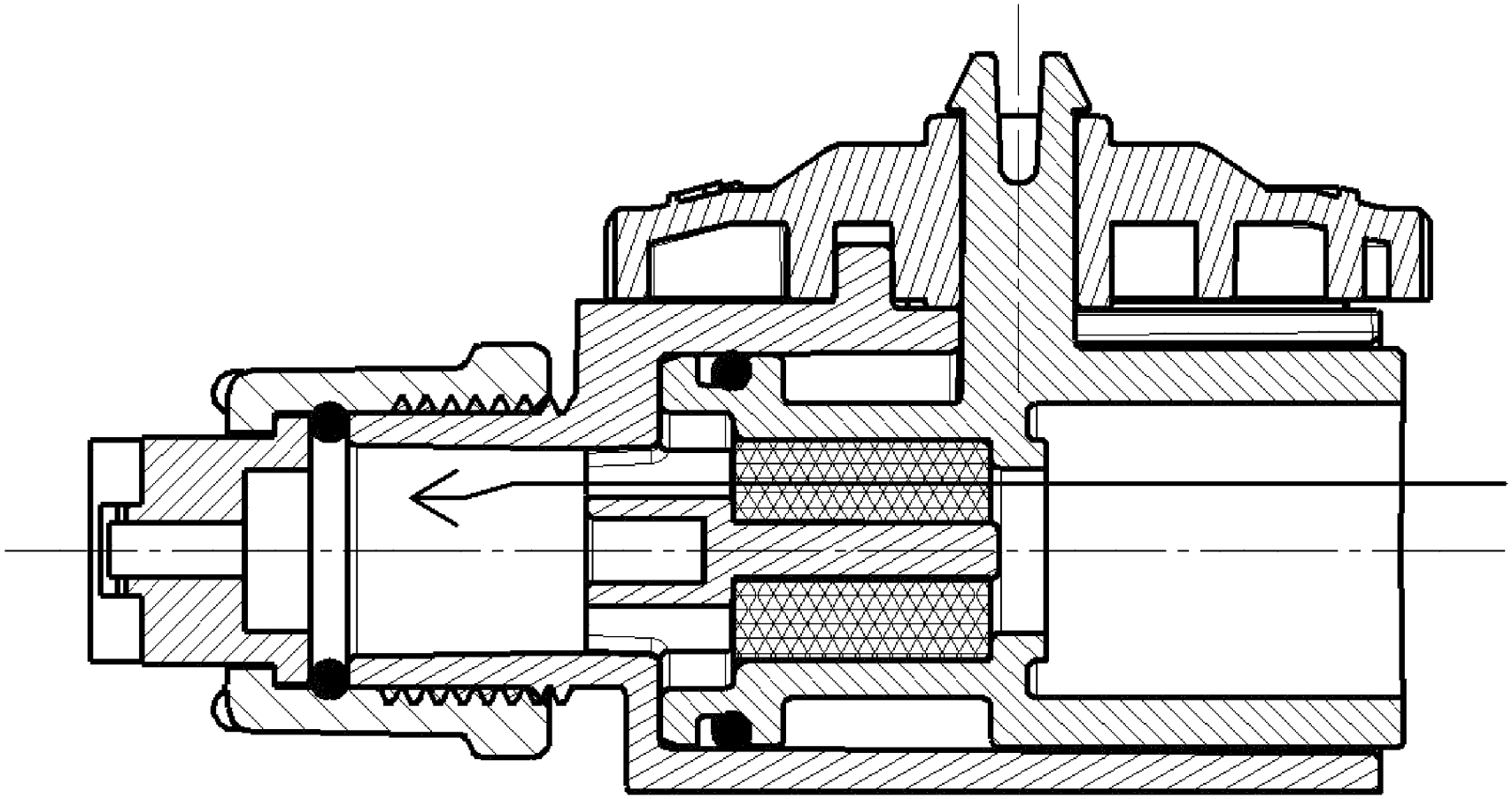
Figure 17:
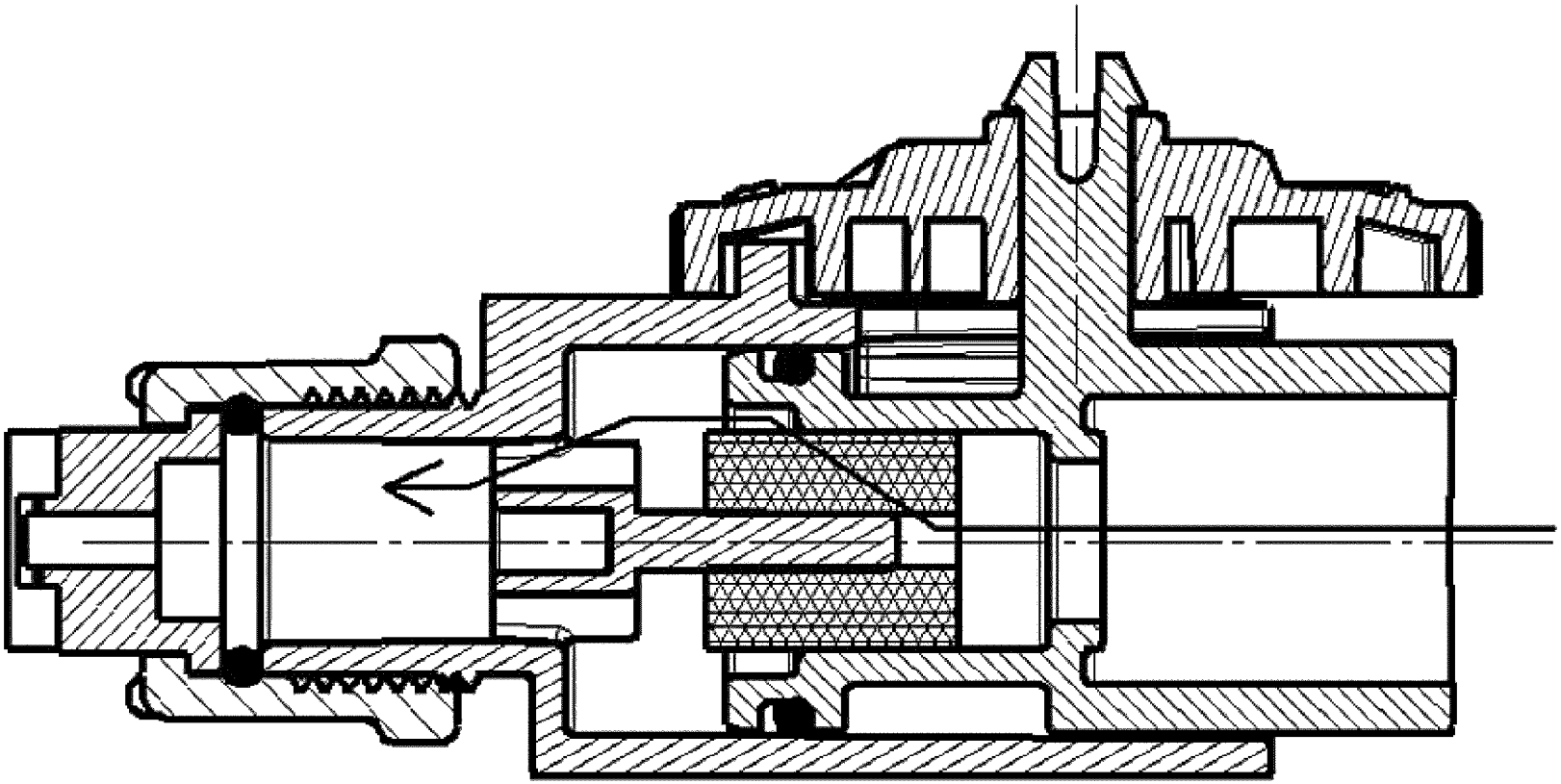
Figure 18:
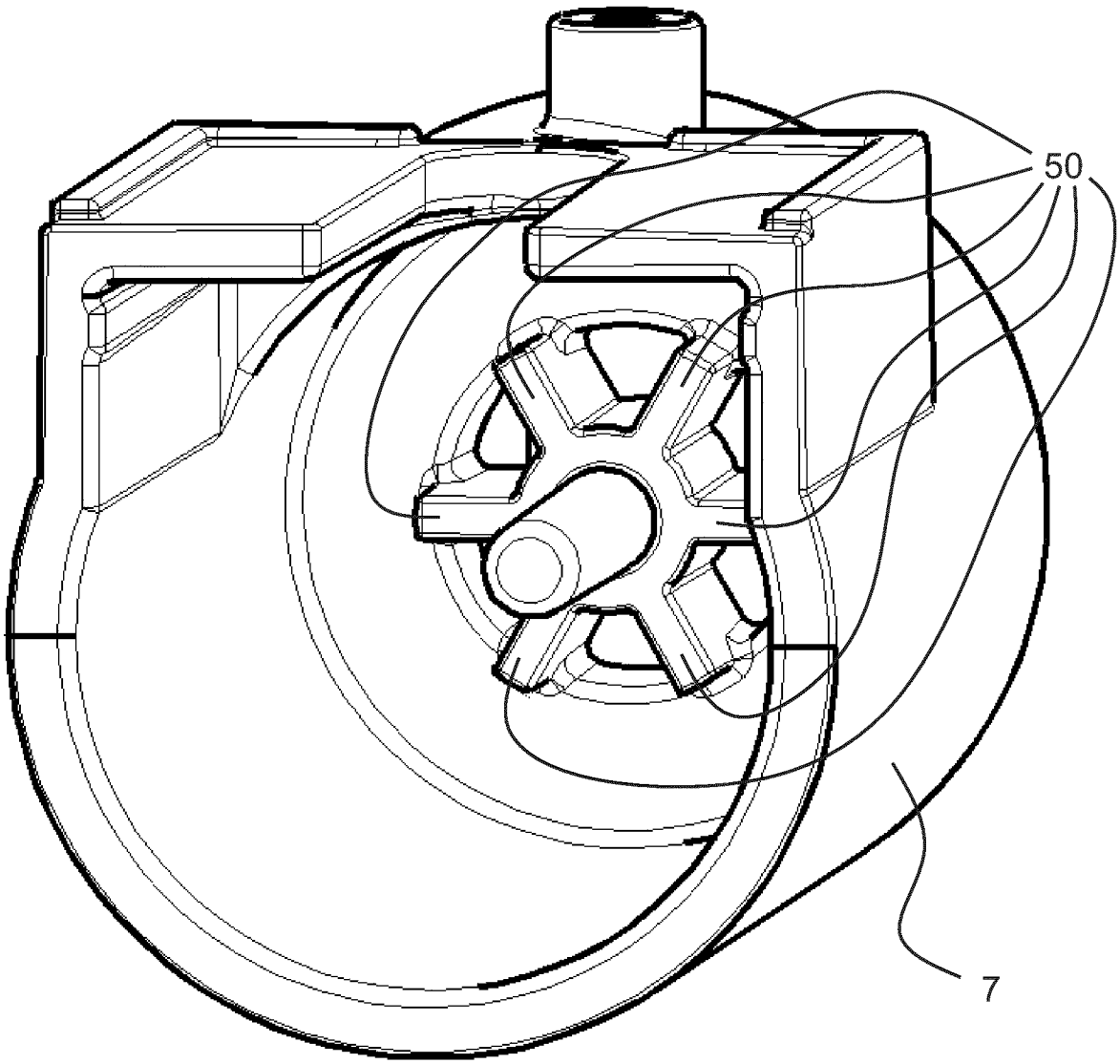

FIG. 8 isometrically shows an adjustment wheel;

FIGS. 9 and 10 are longitudinal sections through a further exemplary embodiment of a foaming unit according to the invention;

FIG. 11 to 17 are various views of further embodiments of foaming units according to the invention; and FIG. 18 is a view of a slide that has ribs.

DESCRIPTION OF EMBODIMENTS

The same components have the same reference signs in all representations, and that said with respect to one figure also applies accordingly to the other figures. Significant differences are indicated in the description of the figures.

Figure 1A:
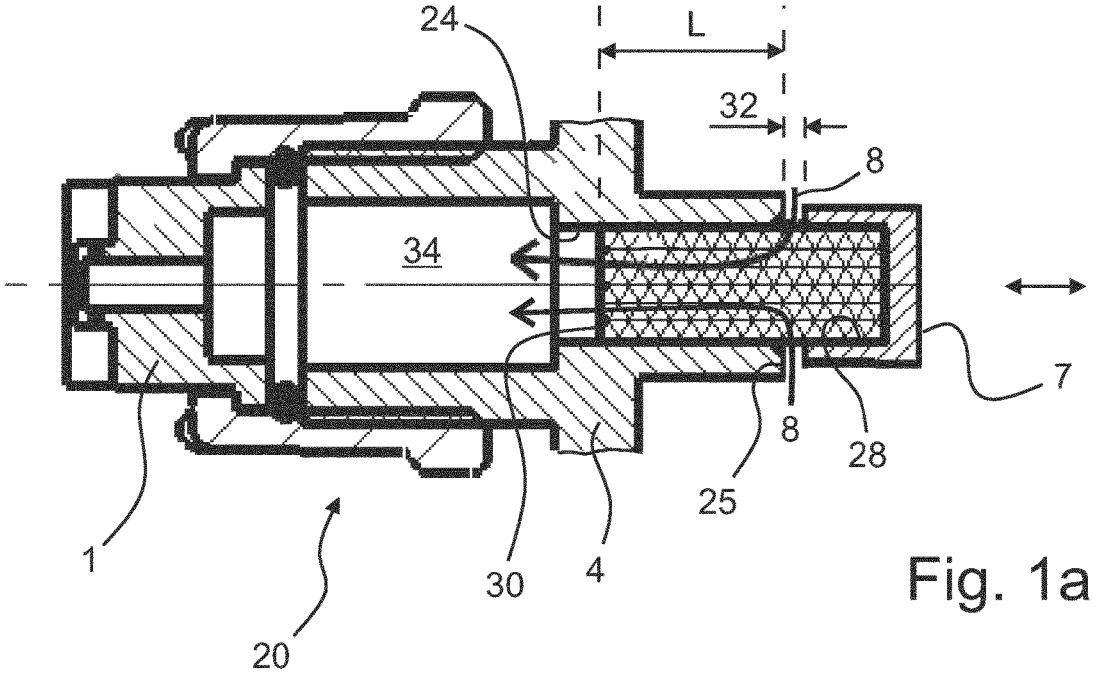

FIGS. 1*a*) and *b*) schematically show a first embodiment of a foaming unit according to the invention. Only the components that are essential for understanding the invention are shown. The foaming unit comprises a slide 4 on which a spray nozzle 1 is arranged by means of a union nut 20 (see FIG. 15). In the slide 4, a passage opening 24 is formed in which a foaming element 6 is sealingly, but axially movably guided. The right-hand end of the passage opening 24 as shown in FIGS. 1*a*) and 1*b*) has the function of a control edge and is provided with reference sign 25.

The foaming element 6 is produced as a cylinder made of a porous material. It may also consist of a plurality of portions of different porosity and/or different material.

In this embodiment, the foaming element 6 is sealingly guided in the bore 24. Because a bore 24 having a circular cross section can be most easily produced, the foaming element 6 is formed as a (full) cylinder.

A propellant and a liquid to be foamed are located in a pressure chamber 26. Neither is shown.

The foaming element 6 has an end face 30 on the part guided in the passage opening 24. The other end of the foaming element 6 is accommodated in a liquid-tight manner in a recess 28 in the housing 7, such that in this design no liquid can flow into the foaming element 6 at the right-hand end of the foaming element 6 as shown in FIGS. 1*a*) and *b*) via the end face (no reference sign) present at said end.

In other words: the region of the foaming element 6 located in the recess 28 is not active.

An annular region 32 is present between the housing 7 and the right-hand end of the slide 4 as shown in FIGS. 1*a*) and *b*). Said annular region 32 is delimited by the control edge 25 on one side and by the housing 7 or the recess 28. Said region effectively provides the inlet for the propellant and the liquid into the foaming element 6.

When a lower pressure prevails in the outlet chamber 34, which is formed in the slide 4, than in the pressure chamber 26, this pressure difference drives the liquid and the propellant out of the pressure chamber 26 through the foaming element 6 into the outlet chamber 34.

Since the liquid and the pressurized propellant always choose the path of least resistance, the active part, that is to say the part of the foaming element 6 through which the propellant and liquid flow, is proportional to the length L in a first approximation. The length L is equal to the distance between the control edge 25 and the end surface 30. In other words: in this embodiment, L denotes the length by which the foaming element 6 projects into the receiving bore 24. In the figures, the path of the propellant gas and the liquid through the foaming element 6 is indicated by the reference sign 8

In FIG. 1*a*), the foaming element 6 is inserted very far into the passage opening 24, because the slide 4 has been moved correspondingly far to the right. The relative movement of the housing 7 and the slide 4 is indicated by a double arrow (no reference sign).

In this design embodiment, the region 32 between the housing 7 and the right-hand end of the slide 4 or passage opening 24 as shown in FIG. 1*a*) is relatively small. However, this relatively small entrance surface for the propellant gas and the liquid to be foamed has little or no effect on the foam being produced in the foaming element 6. The essential quantity determining the consistency of the foam being produced is the aforementioned length L.

In the position of the foaming element 6 shown in FIG. 1*a*), the length L is relatively large and, as a result, the active volume of the foaming element 6 is also relatively large. In the context of the invention, at least the part of the foaming element 6 between the control edge 25 and the end face 30 is referred to as the active volume.

The region 32 of the foaming element 6 still contributes to the active volume of the foaming element.

Figure 1B:
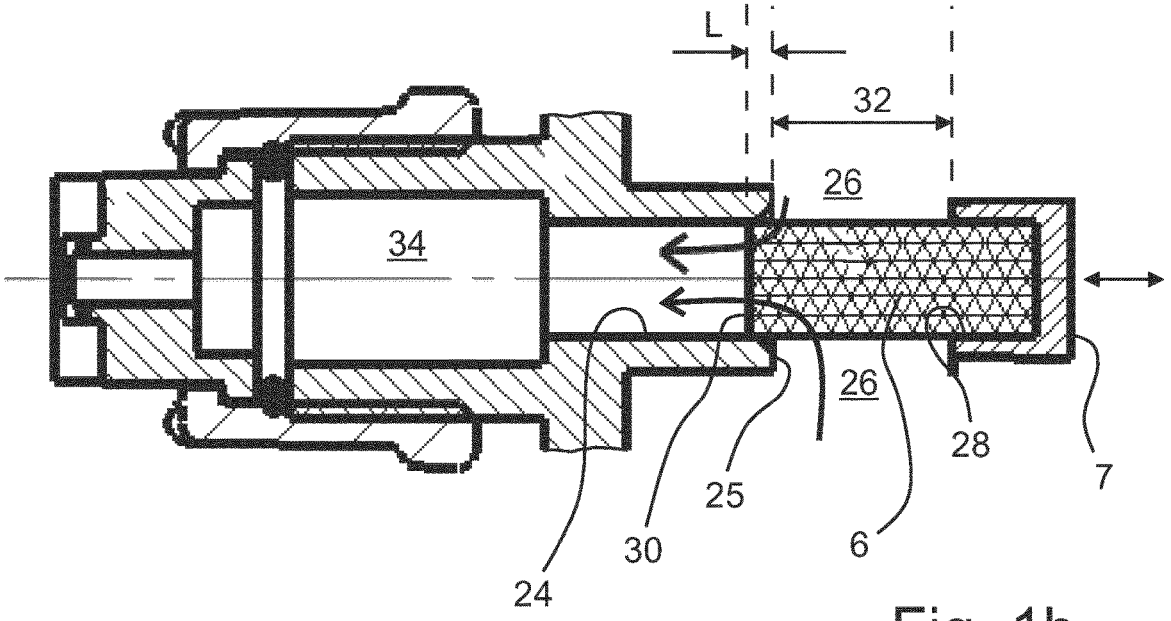

In FIG. 1*b*), the slide 4 has been moved to the left in relation to the position shown in FIG. 1*a*), such that only a short portion of the foaming element 6 is still located in the passage opening 24. The length L in FIG. 1*b*) is therefore much smaller than in FIG. 1*a*). Accordingly, the active volume of the foaming element 6 is also much smaller.

As a result, the foam produced in the foaming unit is relatively dry and solid in the position of the foaming element 6 shown in FIG. 1*a*), whereas it is relatively fluid and less solid at the position of the foaming element 6 according to FIG. 1*b*).

Because the region 32 also contributes at least proportionally to the active volume of the foaming element, the relationship between the length L, that is to say the depth of insertion of the foaming element 6 into the passage opening 24 and the active volume of the foaming element 6, is not necessarily linear. However, there is a direct relationship to the effect that, with increasing depth of insertion L of the foaming element 6 into the passage opening 24, under otherwise identical constraints the foam being produced is more solid and dryer. In other words: by moving the foaming element 6 relative to the control edge 25, the consistency of the foam being produced can be controlled.

Figure 2A:
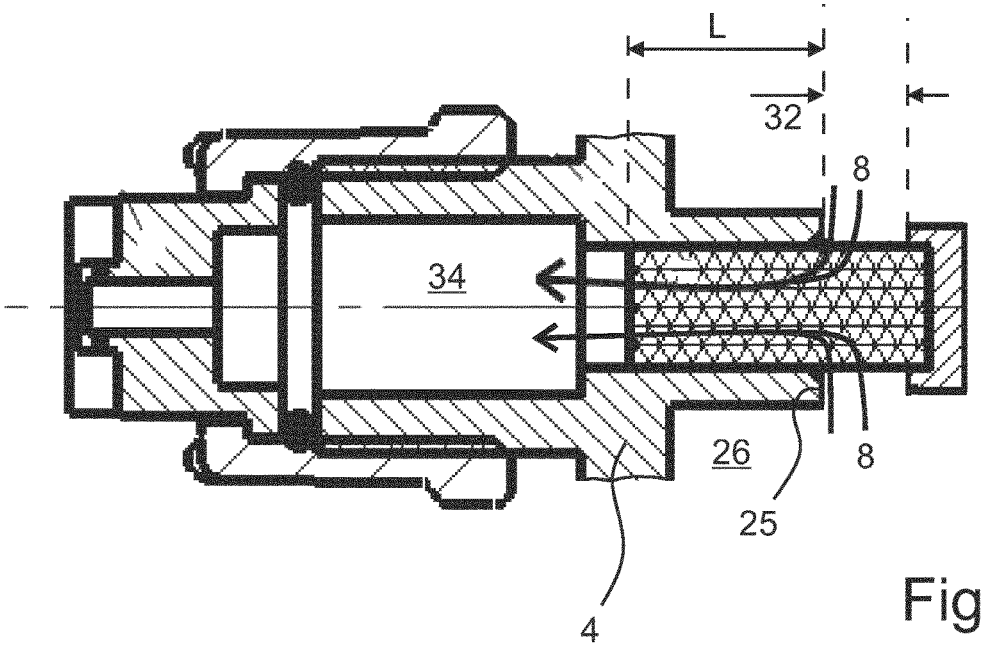
Figure 2B:
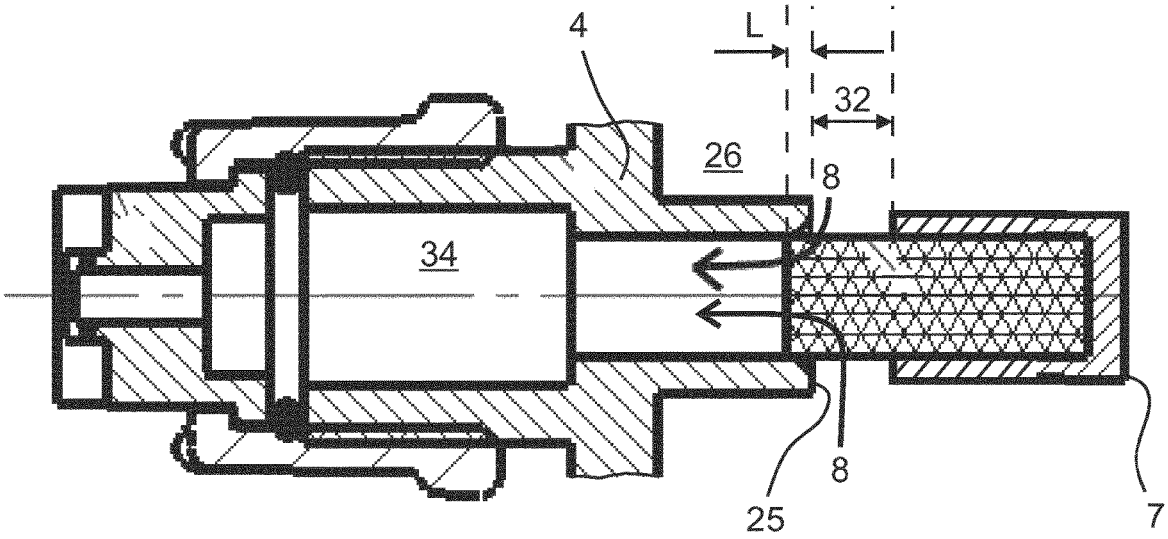

In FIG. 2, a very similar arrangement is also shown schematically and in two positions. In this arrangement, the width 32 of the annular gap between the slide 4 and the housing 7 is constant. Even in an arrangement of this kind, adjusting the consistency of the foam in accordance with the invention can be achieved very effectively by inserting the foaming element 6 into the passage opening 24 to a greater or lesser extent.

The characteristic curves of the schematic embodiment shown in FIGS. 1*a*) and 1*b*) on the one hand and in FIGS. 2*a*) and *b*) on the other hand differ slightly. Both variants are fully functional.

A detailed embodiment of the foaming unit according to the invention is shown in different views in FIG. 3 to 6. It is based on FIGS. 1 and 2. Therefore, for reasons of clarity, not all reference signs are entered. For example, the length L is not shown.

Figure 3:
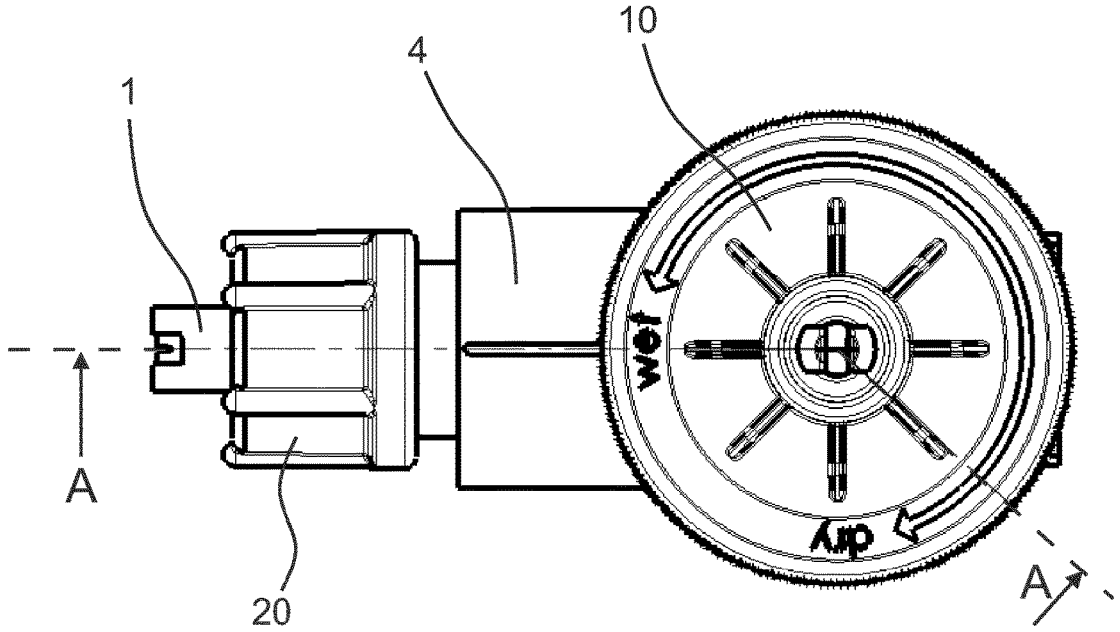
FIG. 3 to 6 show various views of an embodiment of a foaming unit according to the invention.
Figure 4:
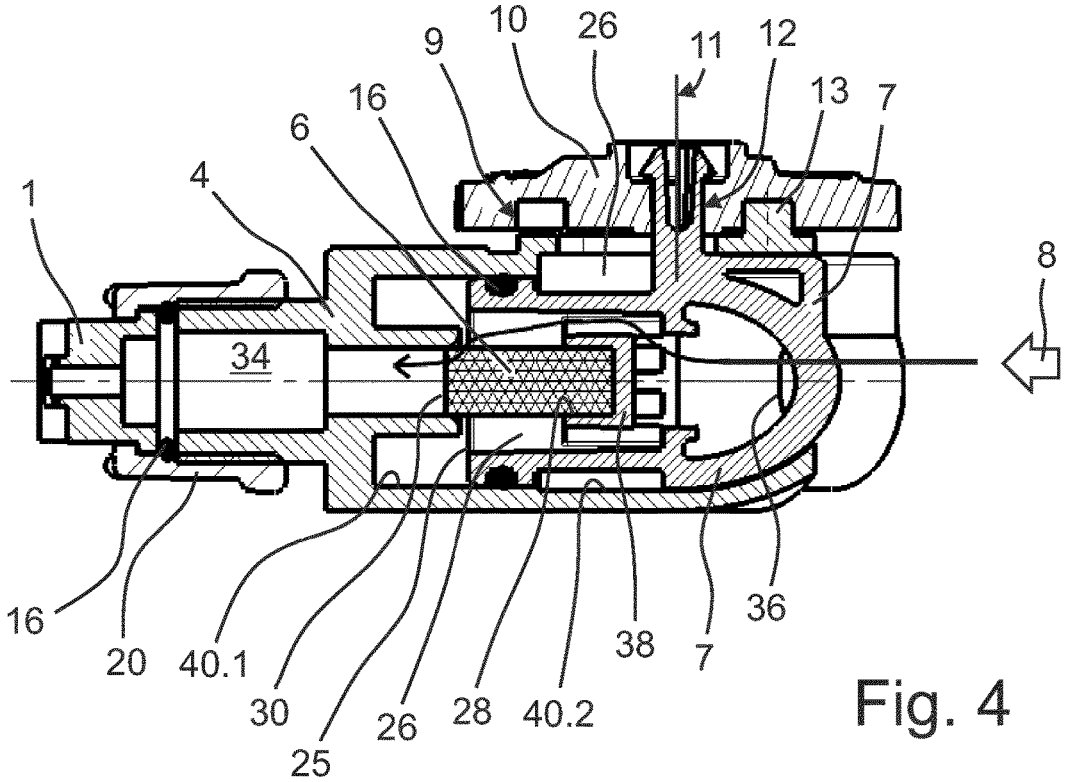
Figure 5:
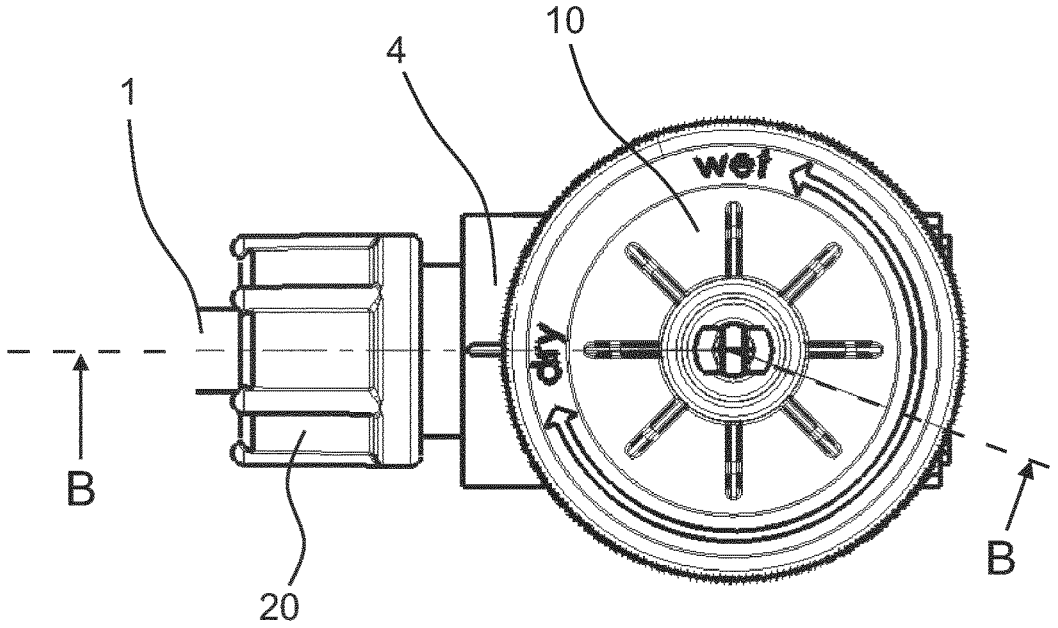

FIGS. 3 and 4 show this embodiment in a view from above and a section along the line A-A in the case of a small active volume of the foaming element 6. The same embodiment is also shown in FIGS. 5 and 6 in a top view and in a sectional view in the case of a large active volume of the foaming element 6.

FIG. 3 shows the foaming unit according to the invention from above. Visible are an adjustment wheel 10, which is used to actuate the foaming unit according to the invention, the slide 4 as well as a spray nozzle 1 and a union nut 20.

In FIG. 4, the foaming unit is shown in section, along the line A-A from FIG. 3.

Figure 6:
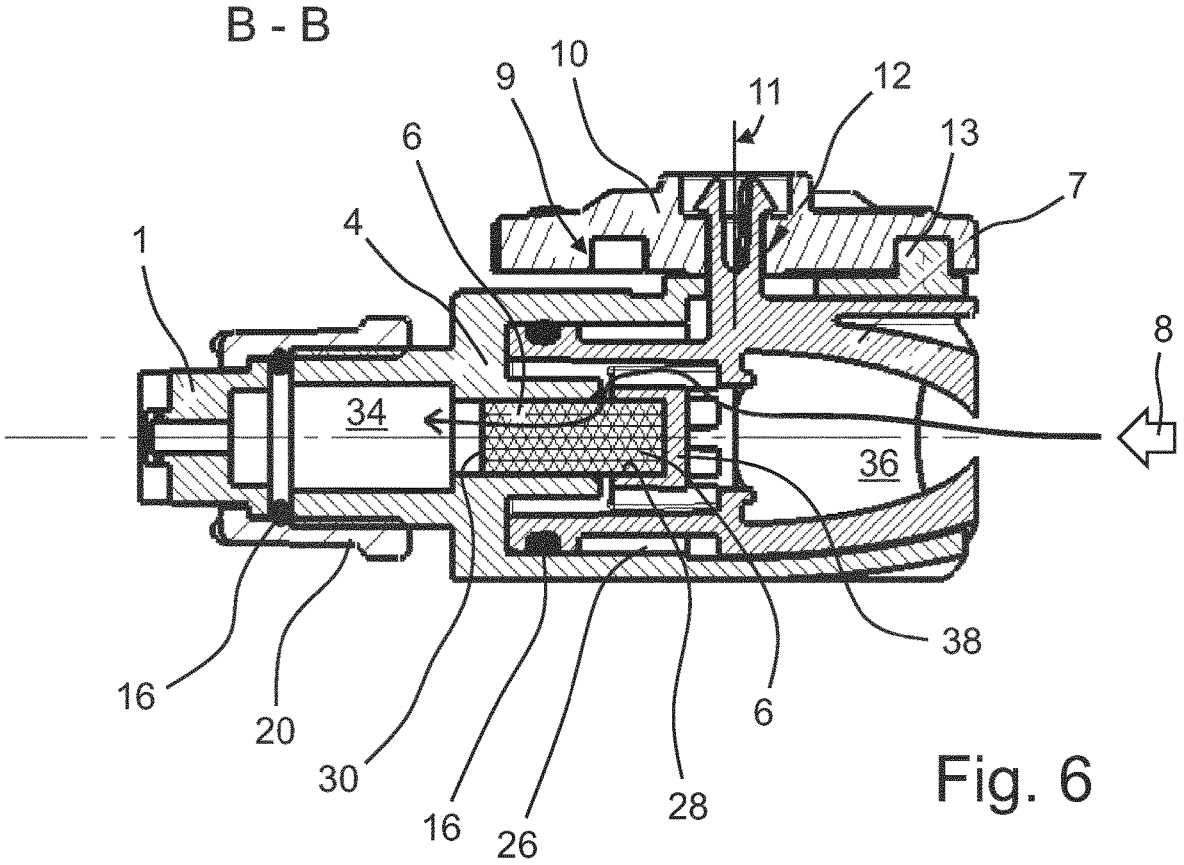

The housing 7 is shown more comprehensively in FIGS. 4 and 6 than in the embodiment according to FIGS. 1*a*) and *b*). The housing 7 has, at the right end thereof as shown in FIG. 4, an inlet 36. This inlet 36 or this inlet opening is barely visible. However, it is clear from the arrow 8 that the mixture of propellant gas and liquid passes from the right through the mentioned inlet opening into the housing 7. The housing 7 has a cup 38 in which the recess 28 for the foaming element 6 is located. The cup 38 is thus connected to the actual housing 7 in such a way that there is a hydraulic connection between the inlet 36 of the housing 7 and the pressure chamber 26. This occurs by openings being formed in the periphery of the cup 38 which allow the flow path indicated by the arrow 8 to pass from the inlet 36 into the pressure chamber 26.

Obviously, other design embodiments are also possible. In this connection, it is important for the cup 38 to connected to the actual housing 7 in such a way that there is a hydraulic connection between the inlet 36 and the pressure chamber 26.

The guiding of the slide 4 in the housing 7 is carried out in this embodiment by a stepped bore 40 comprising portions 40.1 and 40.2. In the housing 7, an annular groove is formed which is used to receive an O-ring or a different sealing element/sealing ring 16. This ensures that neither propellant nor liquid escapes from the pressure chamber 26 into the surroundings. The only hydraulic path along which the propellant gas and the liquid can flow is that from the chamber 26 into the outlet 34 through the active volume of the foaming element 6.

In FIG. 4, the active volume of the foaming element 6 is minimal, similarly to as was shown in FIGS. 1*b*) and 2*b*). For reasons of clarity, the length L and the region 32 were not included in FIG. 4.

The same embodiment of a foaming unit is shown in FIGS. 5 and 6, in which, in the position of the slide 4 as shown in FIGS. 5 and 6, the active volume of the foaming element is at a maximum because the foaming element 6 is inserted as far as possible into the passage opening 24.

The movement of the slide 4 relative to the housing 7 takes place in this embodiment by means of a cam mechanism. By moving the slide 4, the foaming element 6 is covered by the passage opening to a greater or lesser extent and thus the active volume of the foaming element 6 is controlled. The cam mechanism comprises a pin 13 which is formed on the slide 4, and an adjustment wheel 10 which is rotatably mounted on a bearing pin 12 which is in turn part of the housing 7.

Figure 7:
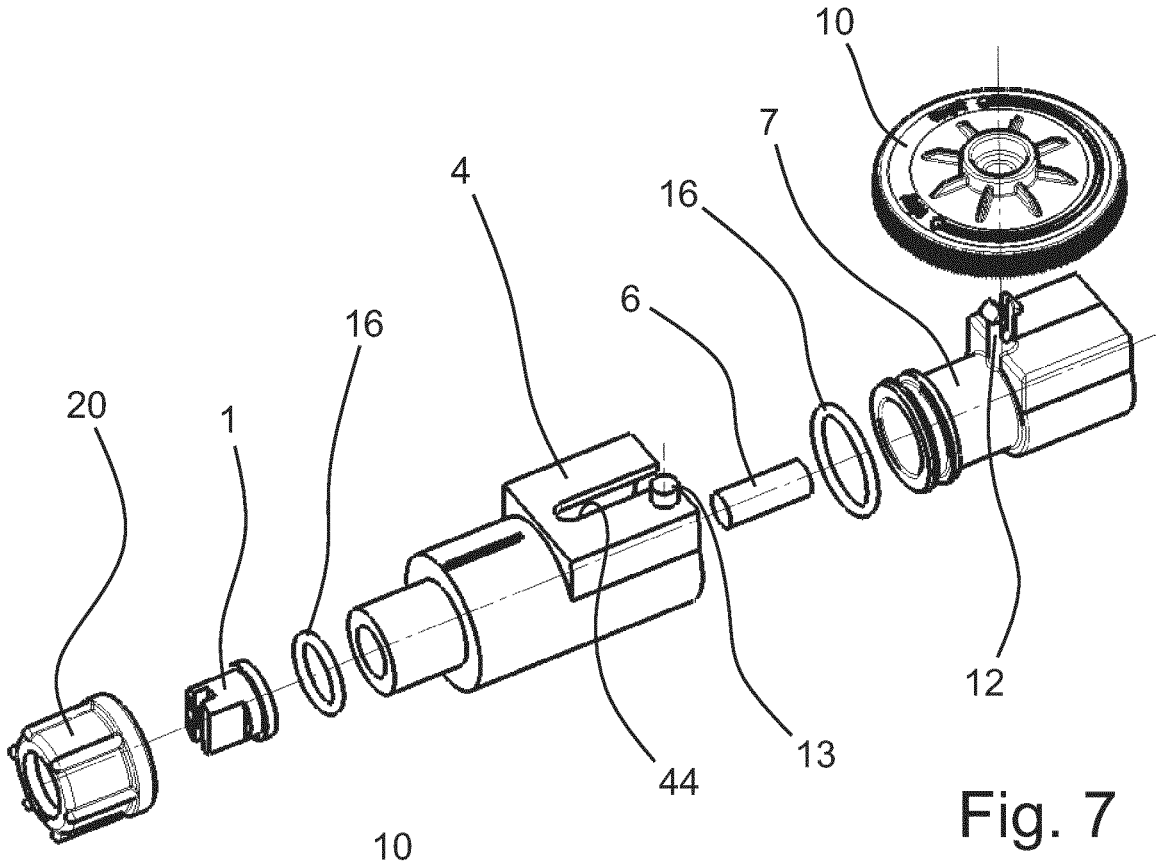
FIG. 7 shows the embodiment according to FIG. 3 to 6 in an exploded view.

FIG. 7 is an exploded view of the foaming unit according to the invention. In said view, it is clear that the bearing pin 12 moves in a longitudinal groove 44 in the slide 4. The longitudinal groove 44 is open at the right-hand end as shown in FIG. 7, such that the slide 4 can be pushed onto the housing 7 from the left. In this case, the sealing ring 16 is attached to the housing 7 and the foaming element 6 is accommodated in the recess 28.

When the housing 7 and slide 4 are joined together, the adjustment wheel 10 is mounted by being clipped, from above, onto the bearing pin 12, which is designed as a clip element.

A (control) groove 9 on the underside of the adjustment wheel 10 is shown in FIG. 8. The pin 13 is inserted into the (control) groove 9.

When the mounted adjustment wheel is rotated by approximately 270°, the housing 7 and slide 4 move relative to each other between the positions shown in FIGS. 4 and 6. As a result, the active volume of the foaming element 6 is adjusted and, consequently, the consistency of the foam is also adjusted.

FIGS. 9 and 10 show a further embodiment of the foaming device according to the invention. An essential difference from the preceding embodiments can be seen in the fact that the housing 7 is formed in two parts and the two housing parts 7.1 and 7.2 are connected to each other by means of a coupling element 5. The foaming element 6 is connected to the housing 7 in such a way that it does not perform any movement relative to the slide 4. In this embodiment, a sleeve nut 46 has the function of the "slide" 4.

The foaming element 6 is designed as a hollow cylinder and is pushed onto the coupling element 5. The end face 30 is therefore annular.

The two parts 7.1 and 7.2 of the housing and the coupling element 5 can be detachably connected (for example by a nut 2) or—after the sleeve nut 46, the foaming element 6 and the sealing rings 16 have been assembled—non-detachably connected.

In this embodiment, the slide 4 and the control edge 25 are integrated into the sleeve nut 46. The sleeve nut 46 is screwed onto the part 7.2 of the housing. The sleeve nut 46 is formed as a tubular portion comprising a passage opening 48 which receives the foaming element 6 in a sealingly but axially movable manner. The control edge 25 is formed at the right end of the tubular portion as shown in FIG. 9.

Sealing rings 16 are provided between the housing 7 and the sleeve nut 46.

When the sleeve nut 46 is rotated relative to the housing 7, the position of the control edge 25 and with it the active volume of the foaming element 6 is altered. The active volume in FIG. 9 is minimal. In FIG. 10, the position of the sleeve nut 46 is shown in such a way that the active volume is at a maximum.

In this embodiment, the inlet 36 is integrated into the housing 7. In this embodiment, there is also a hydraulic connection between the inlet 36 and the chamber 26. Propellant and liquid pass from the chamber 26 into the foaming element 6 in the manner described previously.

A further embodiment of the foaming unit according to the invention is shown in different views in FIG. 11 to 14. It has similarities with the embodiment shown in FIG. 3 to 6. Therefore, only the essential differences are explained.

Figure 11:
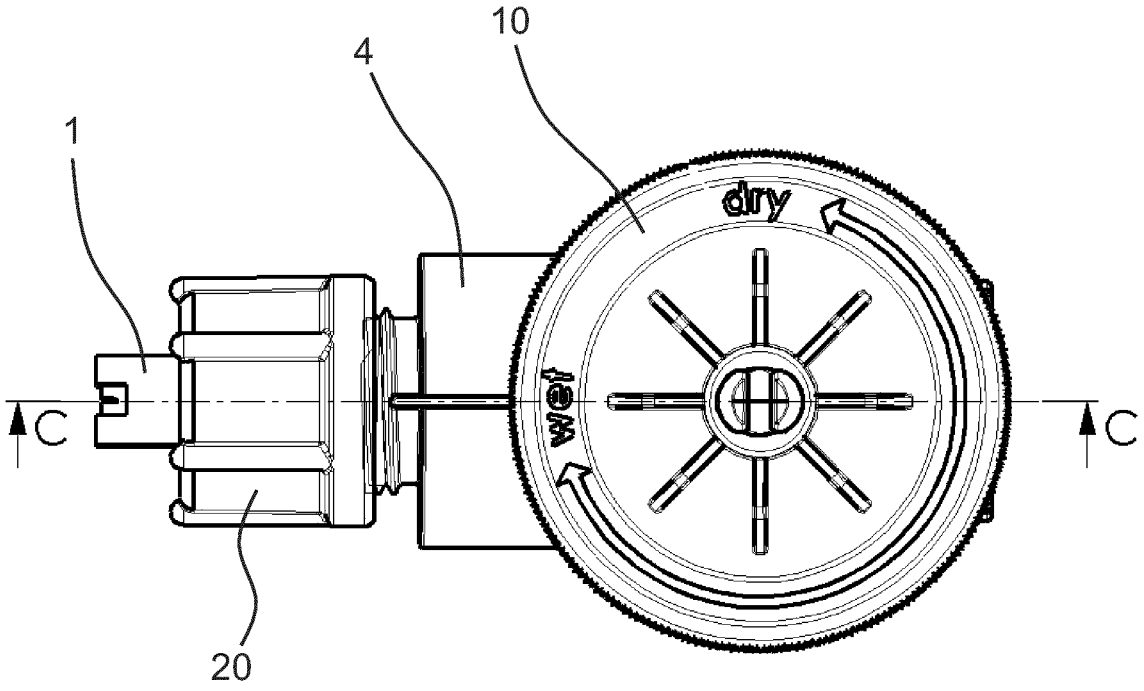
Figure 12:
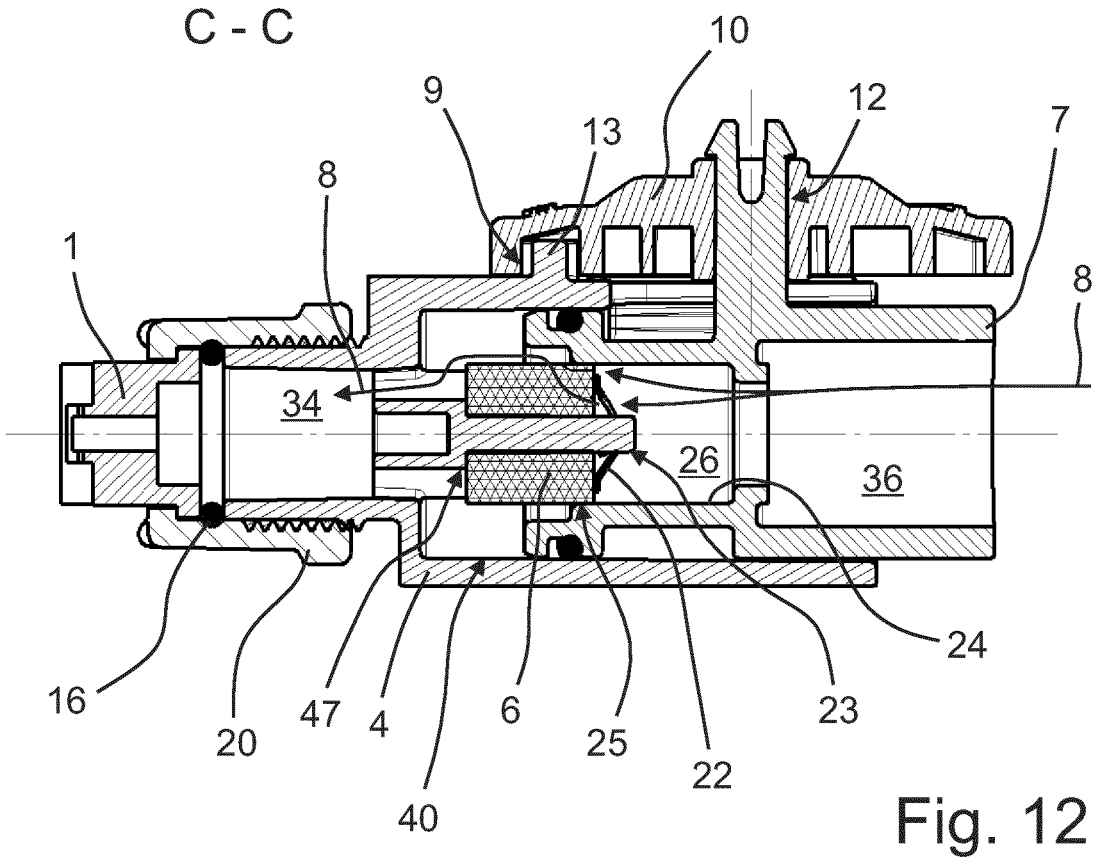
Figure 13:
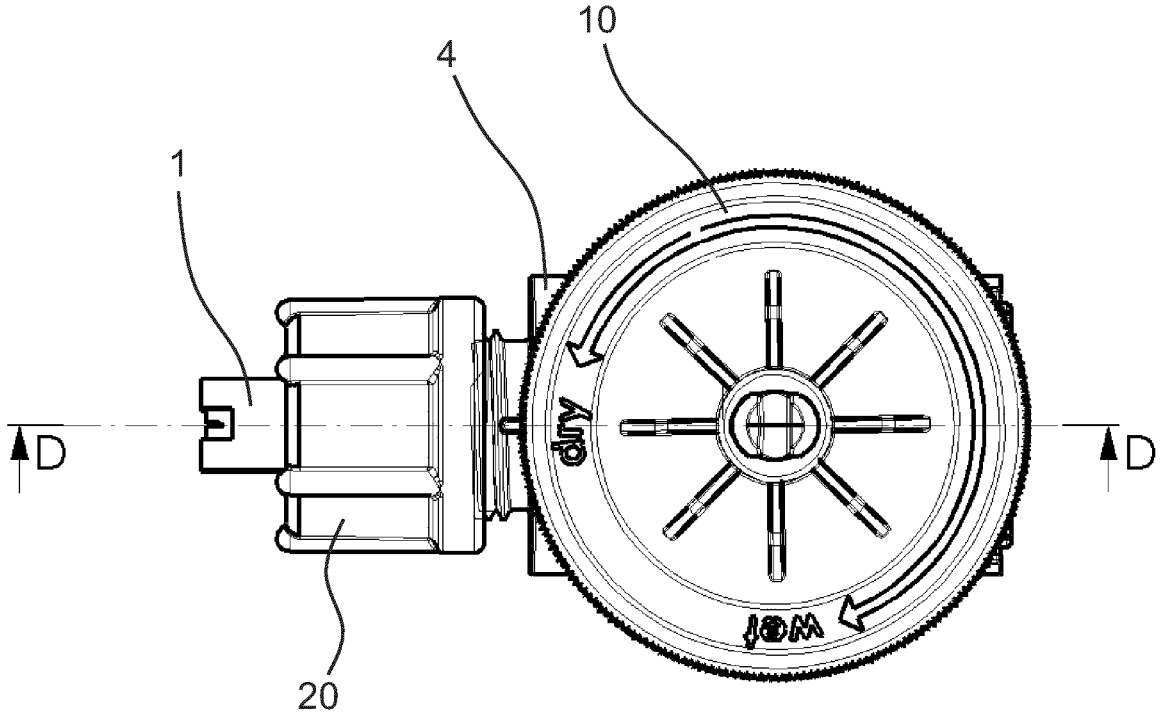
Figure 14:
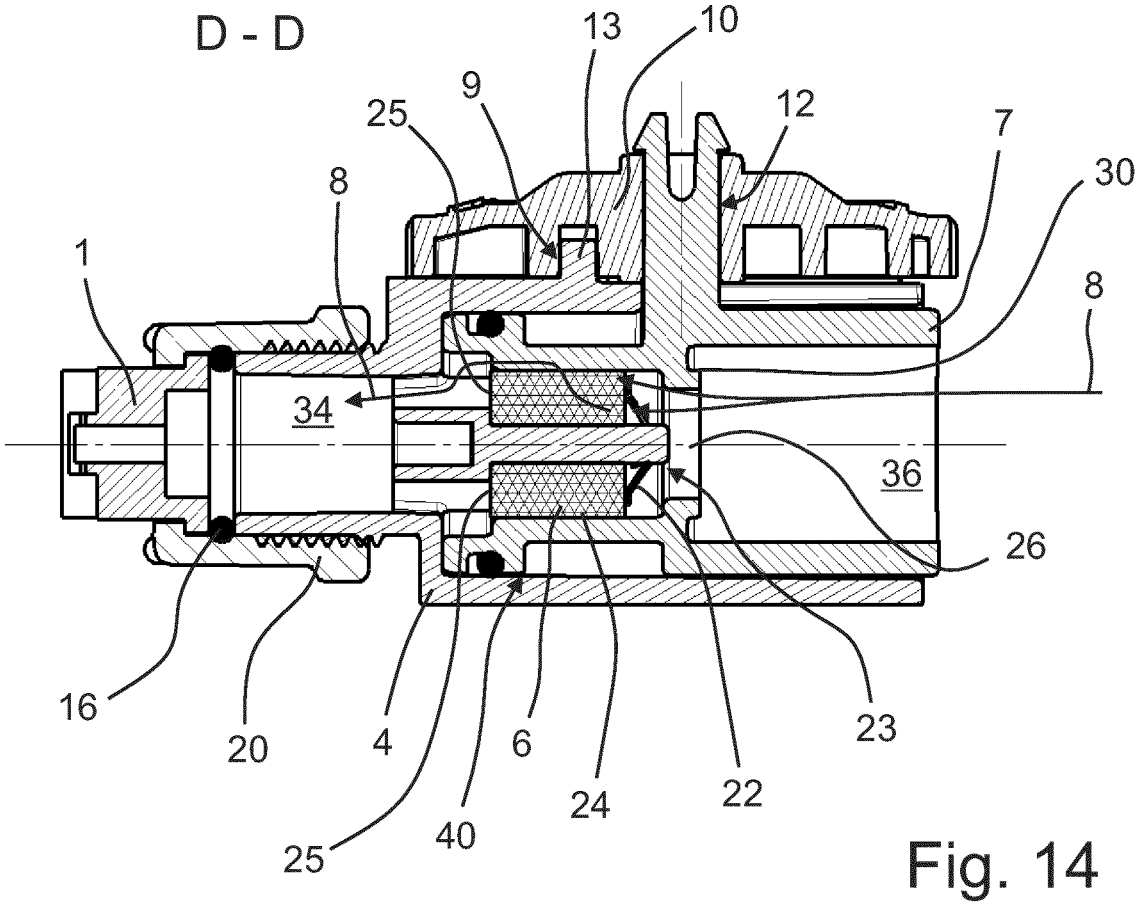

FIG. 12 shows a section along the line C-C in FIG. 11 in the case of a small active volume of the foaming element 6. The same embodiment is also shown in FIGS. 13 and 14 in a plan view and in a sectional view in the case of a large active volume of the foaming element 6.

In FIG. 12, the foaming unit is shown in section, along the line C-C from FIG. 11.

In this embodiment, a receiving pin 23 for the foaming element 6 is integrally formed on the slide 4. The foaming element 6 designed as a hollow cylinder is pushed on the receiving pin 23 and is held by a lock washer 22 (for example a star lock washer) or a Seeger ring. In FIGS. 12 and 14, the left-hand end face of the foaming element 6 bears against a contact shoulder 47.

The lock washer 22 is designed in such a way that liquid and propellant gas pass from the chamber 26 into the foaming element 6 and then the foam passes into the outlet 34. For this purpose, longitudinal openings (no reference signs) are formed in the contact shoulder 47.

Alternatively, a hydraulic connection between the chamber 26 and the foaming element 6 can be created by the receiving pin 23 being connected to the rest of the slide 4 by means of ribs. This variant is shown in FIG. 18. The ribs have the reference sign 50.

In this embodiment, the passage opening 24 and the control edge 25 are integrated into the housing 7.

In this embodiment, liquid and propellant gas enter at one end face of the foaming element 6 and exit at an annular side surface. This path is indicated by the arrow 8.

The same embodiment of a foaming unit is shown in FIGS. 13 and 14, in which, in the position of the slide 4 as shown in FIGS. 13 and 14, the active volume of the foaming element 6 is at a maximum because the foaming element 6 is inserted as far as possible into the passage opening 24.

As is clear from FIG. 14, the foam on the left-hand end face 30 exits from the foaming element 6 and enters into the longitudinal openings in the contact shoulder 47, such that the entire volume of the foaming element 6 is actively involved in foam formation.

The movement of the slide 4 relative to the housing 7 takes place in this embodiment exactly as explained in connection with FIG. 3 to 7.

Figure 15:
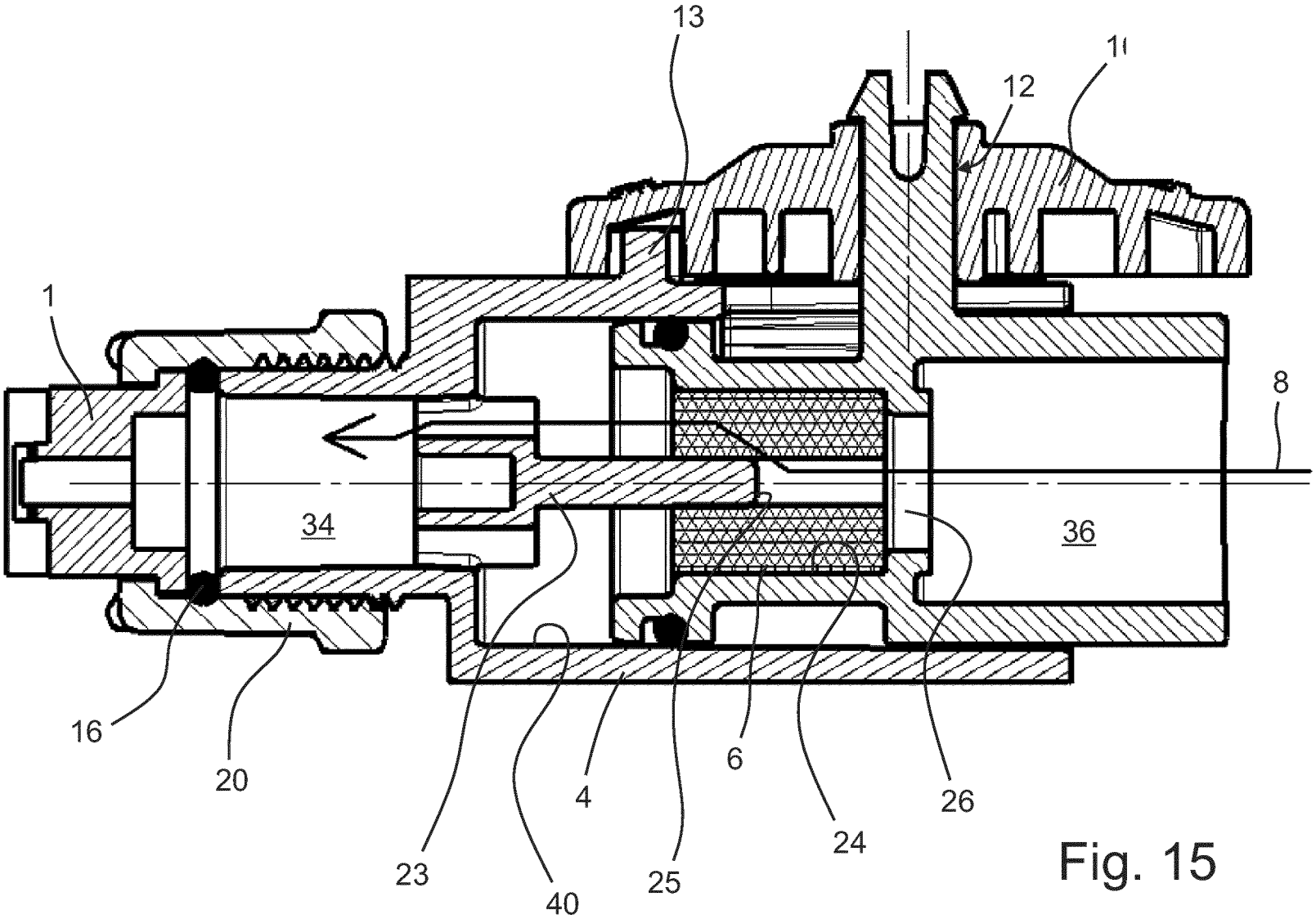

A further embodiment of the foaming unit according to the invention is shown in various views in FIG. 15 to 17. It has similarities with the embodiment shown in FIG. 11 to 14. Therefore, only the essential differences are explained.

An essential difference from the embodiment described above is that the foaming element 6 is not held on the pin 23 by a lock washer 22. Instead, the foaming element 6 is fixed in the passage opening 24, for example, by a press fit, a bond or a securing element (not shown). As a result, the pin 23 assumes the function of the slide. The right-hand end of the pin 23 as shown in FIG. 15 to 17 is the control edge 25.

In FIG. 15, the pin 23 is pulled very far from the foaming element 6, such that the active volume is small and, as a result, a moist foam is produced.

In FIG. 16, the pin 23 is pushed very far into the foaming element 6, such that the active volume is large and, as a result, a dry and solid foam is produced.

FIG. 17 is intended to illustrate that this embodiment also works when the foaming element 6 "wanders" relative to the passage opening 24. Fixing the foaming element 6 in the passage opening 24 therefore has only a minor importance.

The invention claimed is:

1. A foaming unit for producing foam from a mixture of gas and liquid, the foaming unit comprising:

a housing;

a slide;

a foaming element;

an inlet for the mixture of gas and liquid and an outlet, wherein the slide and the housing being movable relative to each other, the foaming element being arranged hydraulically between the inlet and the outlet, an active volume of the foaming element can be adjusted by changing the relative position of a control edge and an end face of the foaming element, the foaming element is designed as a hollow cylinder and is movably accommodated in a passage opening in the housing, a receiving pin is integrally formed on the slide, the foaming element is held on the receiving pin, and the control edge is arranged on the passage opening; and a device for adjusting the effective volume of the foaming element, wherein by actuating said device, the relative position of the control edge and end face of the foaming element is adjusted, and the device is a cam mechanism that is actuated by an adjustment wheel.

2. The foaming unit according to claim 1, wherein the adjustment wheel is rotatably mounted on the housing, a control groove is formed in the adjustment wheel, and the control groove interacts with a pin formed on the slide.

3. The foaming unit according to claim 2, wherein the slide is designed as a sleeve nut, then a thread interacting with the sleeve nut is present on the housing, the sleeve nut is rotatably mounted on the housing, and a tubular portion having a passage opening and a control edge is formed on the sleeve nut.

4. The foaming unit according to claim 3, wherein the inlet is integrated into the housing or the slide.

5. The foaming unit according to claim 3, wherein the outlet is integrated into the slide.

6. The foaming unit according to claim 3, wherein the foaming element consists of one or more open-pored materials.

7. The foaming unit according to claim 6, wherein said one or more open-pored materials includes felt, non-woven fabric, synthetic fabric, foam and/or metal fabric.

8. The foaming unit according to claim 3, wherein the foaming element has regions of different porosity and/or is assembled from a plurality of individual parts.

9. The foaming unit according to claim 3, wherein a spray nozzle is provided downstream of the foaming element and the outlet.

10. The foaming unit according to claim 1, wherein an end of the receiving pin is the control edge.

* * * * *